US012796852B2

(12) United States Patent
DiAntonio

(10) Patent No.: US 12,796,852 B2
(45) Date of Patent: Nov. 17, 2026

(54) CURTAIN ROD BRACKET

(71) Applicant: Green Park Studios LLC, Andover, MA (US)

(72) Inventor: Lisa DiAntonio, Andover, MA (US)

(73) Assignee: Green Park Studios LLC, Andover, MA (US)

( * ) Notice: Subject to any disclaimer, the term of this patent is extended or adjusted under 35 U.S.C. 154(b) by 0 days.

(21) Appl. No.: 18/813,234

(22) Filed: Aug. 23, 2024

(65) Prior Publication Data

US 2025/0064248 A1 Feb. 27, 2025

Related U.S. Application Data

(60) Provisional application No. 63/534,176, filed on Aug. 23, 2023.

(51) Int. Cl.
*A47H 1/122* (2006.01)
*A47H 1/142* (2006.01)

(52) U.S. Cl.
CPC ..... *A47H 1/142* (2013.01); *A47H 1/122* (2013.01)

(58) Field of Classification Search
CPC . A47H 1/10; A47H 1/102; A47H 1/12; A47H 1/122; A47H 1/14; A47H 1/142; A47H 1/144; A47H 1/104; A47H 1/124
USPC ..... 248/261, 262, 263, 264, 265, 539; D8/363, 366
See application file for complete search history.

(56) References Cited

U.S. PATENT DOCUMENTS 758,098 A * 4/1904 Nordling ..... A47H 1/13 248/257
915,598 A * 3/1909 Hess ..... A47H 1/13 248/258
1,342,230 A * 6/1920 Ruzicka ..... A47H 1/13 248/254
1,376,541 A * 5/1921 Hills ..... A47H 1/142 211/105.3
1,509,098 A * 9/1924 Callender ..... A47H 1/022 248/265
2,597,733 A * 5/1952 Jackson ..... H01Q 1/1221 248/539

(Continued)

FOREIGN PATENT DOCUMENTS

KR 101926611 B1 * 12/2018 ..... A47H 1/142

OTHER PUBLICATIONS

Maytex Smart Rods Easy Install No Measuring Window Cafe Rod—Oil Rubbed bronze—Brown Finish/Bronze Finish, [retrieved from the internet: Jul. 12, 2024] Maytex Smart Rods Easy Install No Measuring Window Cafe Rod—Bed Bath & Beyond—14333042 (bedbathandbeyond.com).

(Continued)

*Primary Examiner* — Jonathan Liu
*Assistant Examiner* — Guang H Guan
(74) *Attorney, Agent, or Firm* — Zachary Rimkunas

(57) ABSTRACT

A bracket for supporting a curtain rod includes a bracket base including an elongate plate having one or more through holes and a sleeve, a bracket arm including a vertical section configured for insertion into the sleeve of the bracket base and a cradle attached to a first end of the bracket arm, the cradle configured to receive a curtain rod. The vertical section of the bracket arm is movable in the sleeve along a first, vertical axis to adjust a distance between the cradle and the bracket base.

14 Claims, 12 Drawing Sheets

(56) References Cited

U.S. PATENT DOCUMENTS

| | | | | | |
|---|---|---|---|---|---|
| 2,783,014 | A * | 2/1957 | Kenney | A47H 1/13 | 248/265 |
| 2,845,243 | A * | 7/1958 | Mowers | H01Q 1/1221 | 248/539 |
| 4,226,395 | A * | 10/1980 | Bellinger | A47H 1/102 | 248/909 |
| 6,155,523 | A * | 12/2000 | Pitre | A47H 1/14 | 248/467 |
| D448,717 | S * | 10/2001 | Hanson | D12/162 | |
| 8,297,576 | B2 * | 10/2012 | McLeod | A47H 1/142 | 248/257 |
| 8,418,975 | B1 * | 4/2013 | Burr | A47H 1/142 | 248/261 |
| D727,803 | S * | 4/2015 | Borkholder | D12/162 | |
| D749,288 | S * | 2/2016 | Madison | D34/31 | |
| 9,851,050 | B1 * | 12/2017 | Cano | A45B 11/00 | |
| 10,278,529 | B2 * | 5/2019 | Baines | A47H 1/122 | |
| 10,542,835 | B1 * | 1/2020 | Suozzo | A47H 1/102 | |
| 11,812,883 | B2 * | 11/2023 | Hanley | A47H 1/122 | |
| 11,834,308 | B2 * | 12/2023 | Dorsey | B60P 1/56 | |
| 12,193,588 | B1 * | 1/2025 | Hanley | A47H 1/102 | |
| 2009/0173457 | A1 * | 7/2009 | Navarro | A47H 5/09 | 160/330 |
| 2013/0099080 | A1 * | 4/2013 | Baines | A47H 1/142 | 248/262 |
| 2025/0064248 | A1 * | 2/2025 | DiAntonio | A47H 1/142 | |

OTHER PUBLICATIONS

Urbanest Adjustable Curtain Rod Bracket, [retieved from the internet: Jul. 12, 2024] Urbanest Adjustable Curtain Rod Bracket, 1 1/8"-1 1/4", Pewter—Walmart.com.

Wileqep Fast Fit No Measure Single Curtain Rod Brackets [retrieved from the internet: Jul. 12, 2024] wileqep Fast Fit No Measure Single Curtain Rod Brackets No Drill No Damage Curtains Every Time—Walmart.com.

* cited by examiner

CURTAIN ROD BRACKET

CROSS-REFERENCES TO RELATED APPLICATIONS

This application claims the benefit of U.S. Provisional Application No. 63/534,176 filed Aug. 23, 2023, the entire contents of which are incorporated herein by reference.

BACKGROUND OF THE INVENTION

This invention relates to a curtain rod bracket that is adjustable after installation.

Curtain rods have long been used as essential components for hanging curtains or draperies in residential, commercial, and industrial settings. Generally, traditional curtain rods are straight, rigid rods made from materials such as metal, wood, or plastic. They often utilize brackets fixed to a wall to support the rod and are equipped with finials or endcaps to secure the curtains in place.

The installation of curtain rod brackets usually involves installing one bracket into a wall on either side of a window. In some examples, installers measure and mark a height for each bracket and then install the bracket at the mark. In other examples, installers use the moulding around the window as a guide for installation. In yet other examples, installers "eyeball" the position of the brackets relative to the window. Regardless of the installation method, the goal is to have the curtain rod (and the curtain) both level and at an appropriate height relative to the top of the window. In yet other examples, another bracket is designed to secure to the wood trim via metal barbs but the rod is not adjustable.

SUMMARY OF THE INVENTION

Successfully installing brackets for curtain rods is notoriously difficult. Measuring from the floor can result in a non-level installation if the floor or the window is not level. Installing brackets level with the window moulding can result in a non-level installation if the window is not level. Eyeballing the position of the brackets almost always results in a non-level installation. Furthermore, even if the installation results in a level curtain rod, many novice installers don't know the appropriate height of the curtain rod relative to the top of the window or the appropriate distance between the bottom of the curtain and the floor, resulting in a curtain that hangs too low or too high relative to the window and/or the floor.

Finally, almost all curtain rod brackets on the market today require that the brackets interact with (e.g., are fastened to) the wall adjacent to the window, which causes unacceptable damage to the wall (e.g., in a rental apartment). If the installer wants to adjust the bracket after installation, they need to remove the bracket from the wall and somehow reinstall the bracket in a new position in the already damaged wall.

Aspects described herein relate to a bracket for a curtain rod that is easy to install in an appropriate position, can be adjusted after installation, and doesn't need to be installed into a wall adjacent to the window. The bracket includes a bracket base configured for attachment to a top, front, and/or side surface of the window moulding. The bracket also includes a bracket arm with a cradle for receiving and supporting an end of a curtain rod. The bracket arm is attached to and movable relative to the bracket base such that a height of the bracket arm can be adjusted after installation of the bracket base.

An installer can quickly install the brackets on either side of a window by attaching the bracket base to the window moulding (and without damaging the walls adjacent to the window). The installer can then adjust the bracket arm on each bracket to the desired height above the window. Finally, the installer can use a level to adjust the heights of the arms, resulting in a level curtain rod installed at a desired height without any damage to the walls.

In a general aspect, a bracket for supporting a curtain rod includes a bracket base including an elongate plate having one or more through holes and a sleeve, a bracket arm including a vertical section configured for insertion into the sleeve of the bracket base and a cradle attached to a first end of the bracket arm, the cradle configured to receive a curtain rod. The vertical section of the bracket arm is movable in the sleeve along a first, vertical axis to adjust a distance between the cradle and the bracket base.

Aspects may include one or more of the following features. The bracket arm may include a horizontal section attached to the vertical section and is substantially "L-shaped." The horizontal section may have a first end attached to an end of the vertical section and the cradle may be attached to a second end of the horizontal section, opposite the first end of the horizontal section. The sleeve may include a through hole for receiving a set screw to fix a position of the vertical section in the sleeve. The cradle may include a through hole for receiving a set screw to fix the curtain rod in the cradle. The bracket base may be configured for installation on a window moulding, with the elongate plate attached to a top surface of the window moulding.

The elongate plate may have a number of through holes located along its length. The through holes may be equally spaced. The sleeve may be cylindrical. The vertical section may be shaped and sized to fit within the sleeve. The cradle may be located above the bracket base when the bracket is installed. The sleeve may be attached to a side of the elongate plate, offset from a second, horizontal axis extending along a length of the elongate plate. At least one of the bracket base and the bracket arm may be formed from a metal. The vertical section may be rotatable about the first, vertical axis.

The bracket base may includes a second elongate plate attached to the first elongate plate in an angle brace configuration. The bracket base may be configured for installation on a window moulding, with the first elongate plate attached to a top surface of the window moulding and the second elongate plate attached to a front surface or a side of the window moulding. The second elongate plate may have a plurality of through holes located along its length.

In another general aspect, a kit includes two or more curtain rod brackets configured with any one of the above features and a curtain rod.

In another general aspect, a method for installing a curtain rod bracket configured according to any one of the above features includes fastening the curtain rod base to a window moulding including fastening the elongate base of the curtain rod bracket to a top, front, and/or side surface of the window moulding, inserting the vertical portion of the bracket arm into the sleeve of the curtain rod base, adjusting a distance between the cradle of the bracket arm and the bracket base to a desired distance, and fixing the position of the bracket arm relative to the bracket base.

Among other advantages, the curtain rod bracket described above is not installed in a wall adjacent to the window like conventional curtain rod brackets—it is installed into the window's moulding. Furthermore, in some examples, the curtain rod bracket is attached to the top of the window's moulding using a thin, elongate plate that is invisible or nearly invisible once installed.

The curtain rod bracket is also advantageously configured to encourage the installation of curtain rods at the correct height above a window. Furthermore, the curtain rod bracket advantageously allows adjustment of the height of installation of the curtain rod after the bracket is installed, preventing removal and reinstallation of the curtain rod, as is required to adjust the height of a curtain rod using conventional brackets.

Other features and advantages of the invention are apparent from the following description and from the claims.

DETAILED DESCRIPTION

1 Overview

Figure 1:
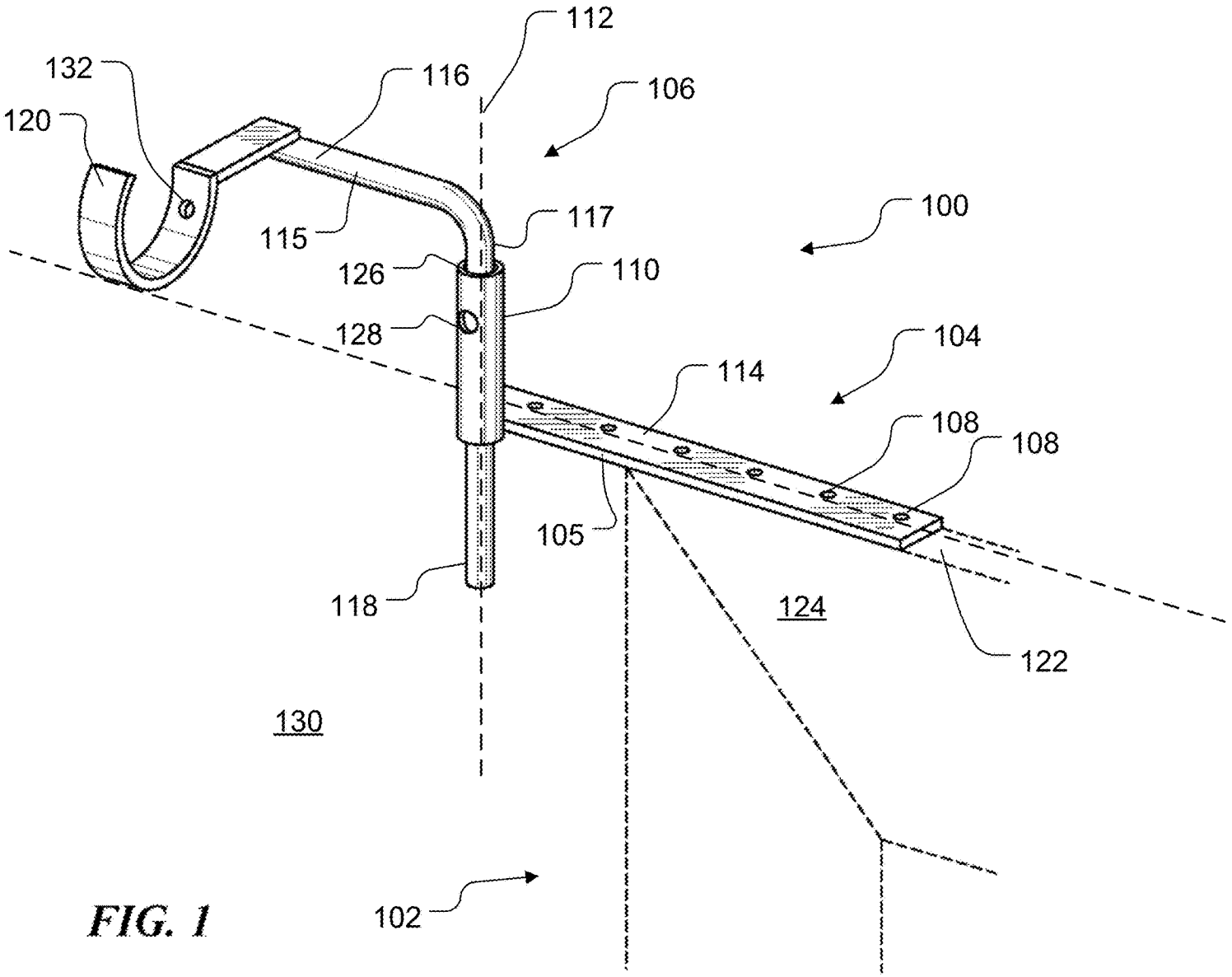
FIG. 1 is a perspective view of a curtain rod bracket installed on one side of a window.
Figure 2:
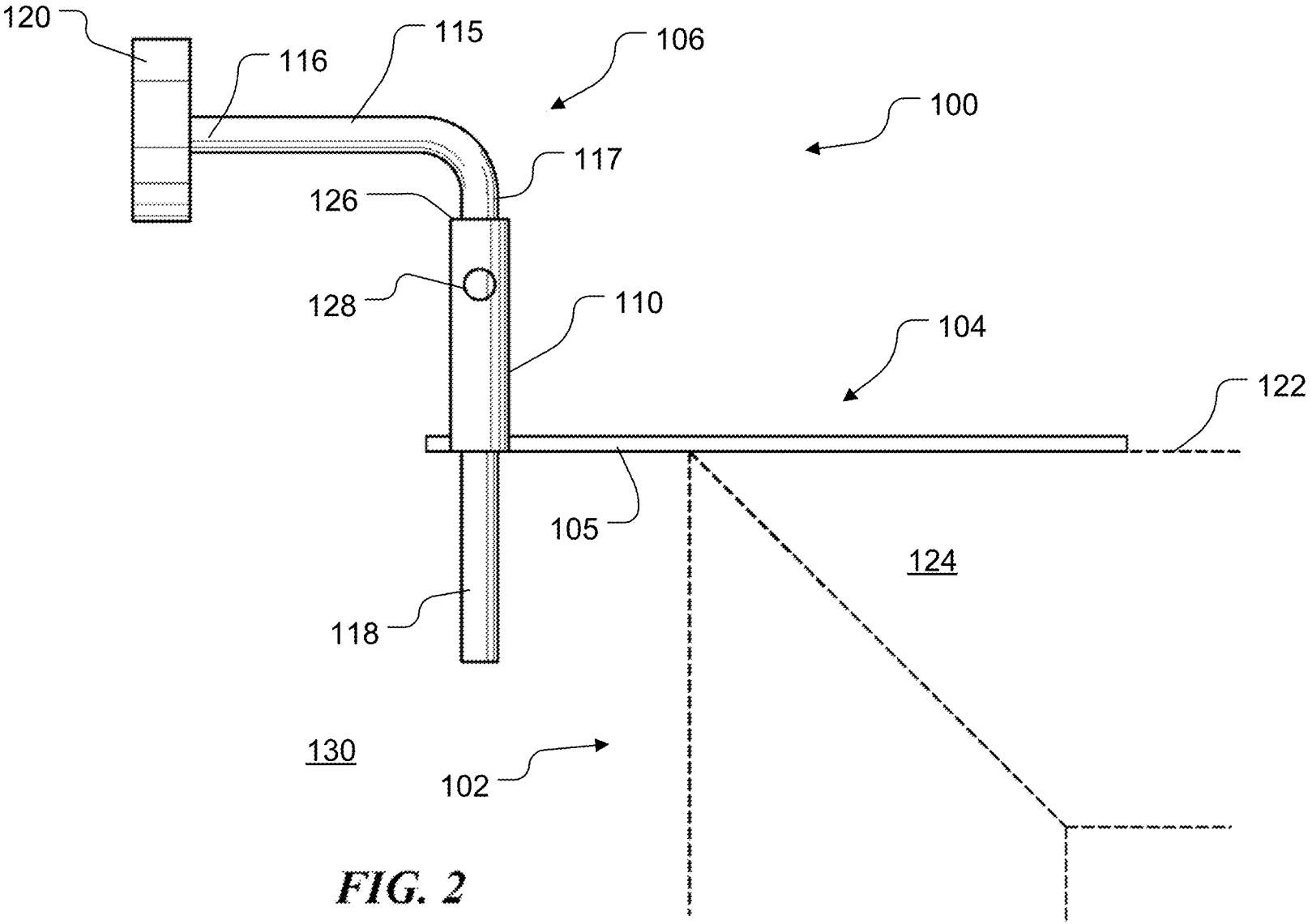
FIG. 2 is a front view of the curtain rod bracket of FIG. 1.
Figure 3:
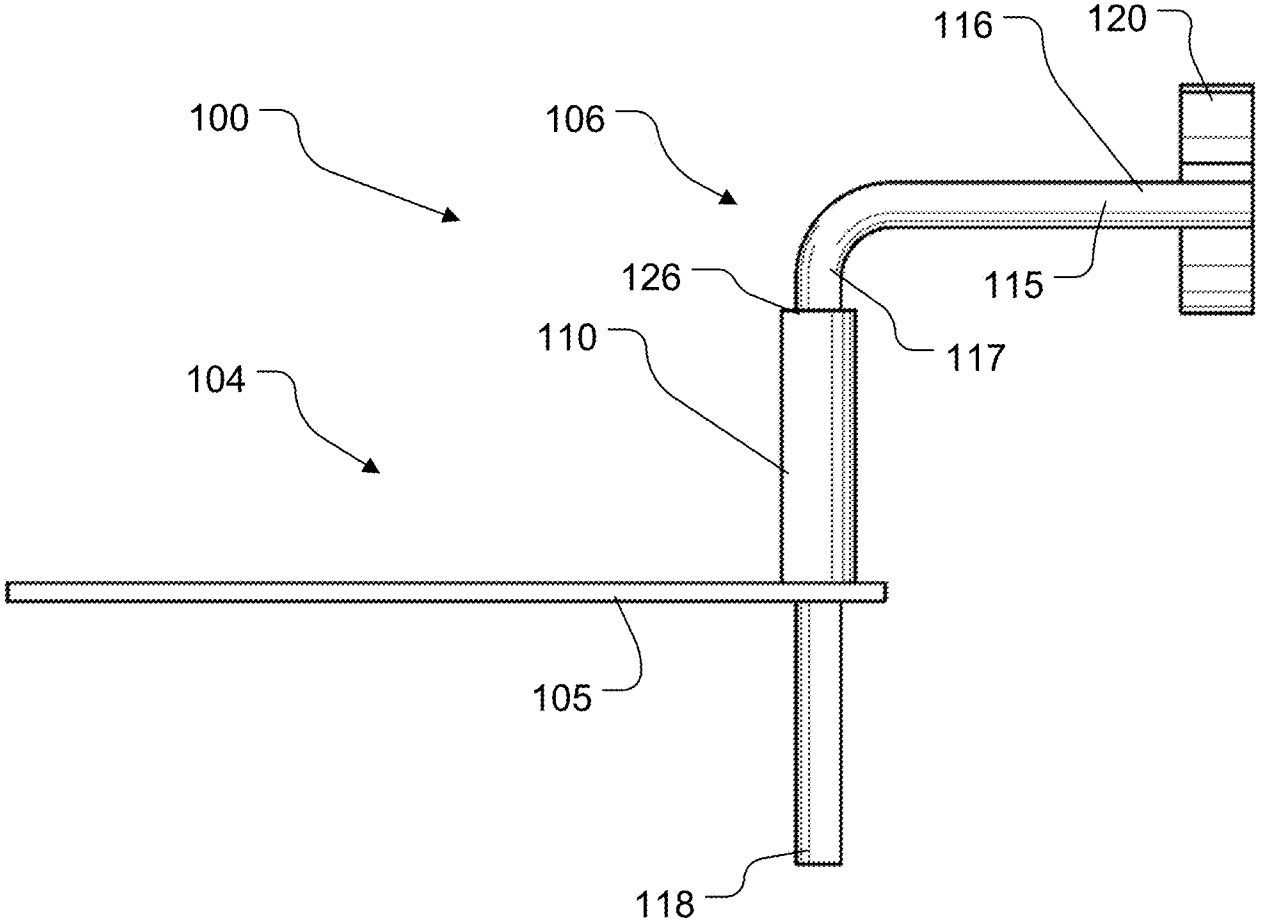
FIG. 3 is a rear view of the curtain rod bracket of FIG. 1.
Figure 5:
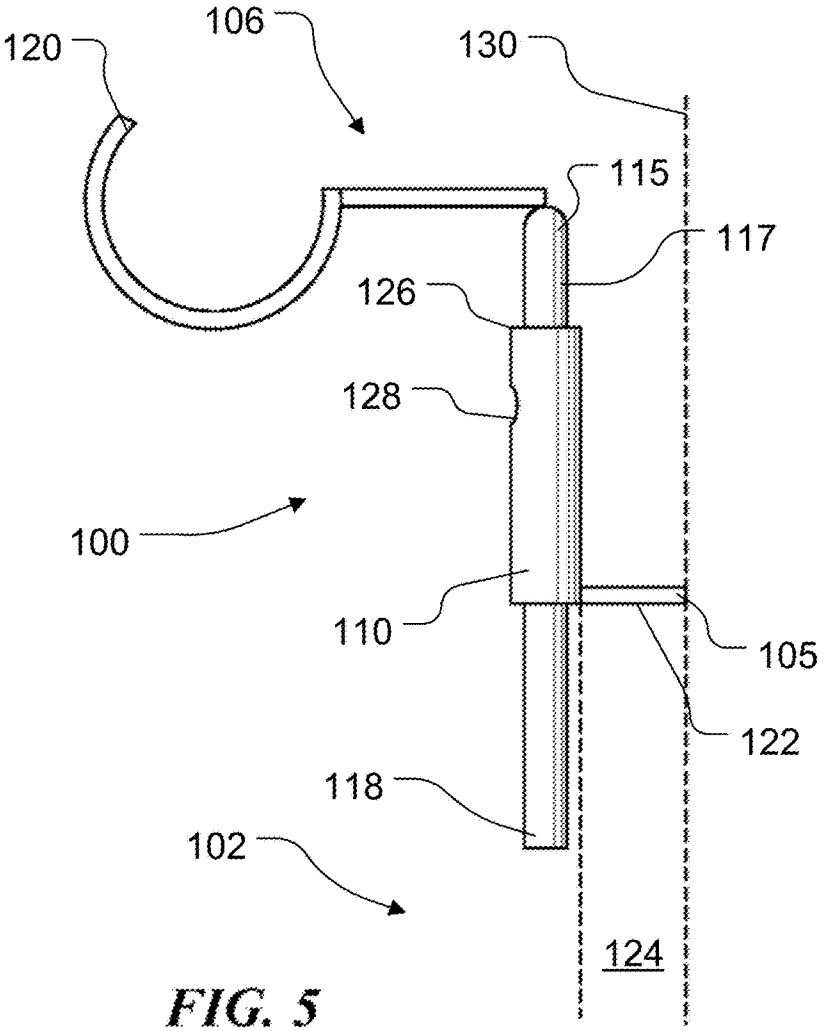
FIG. 5 is a right side view of the curtain rod bracket of FIG. 1.
Figure 4:
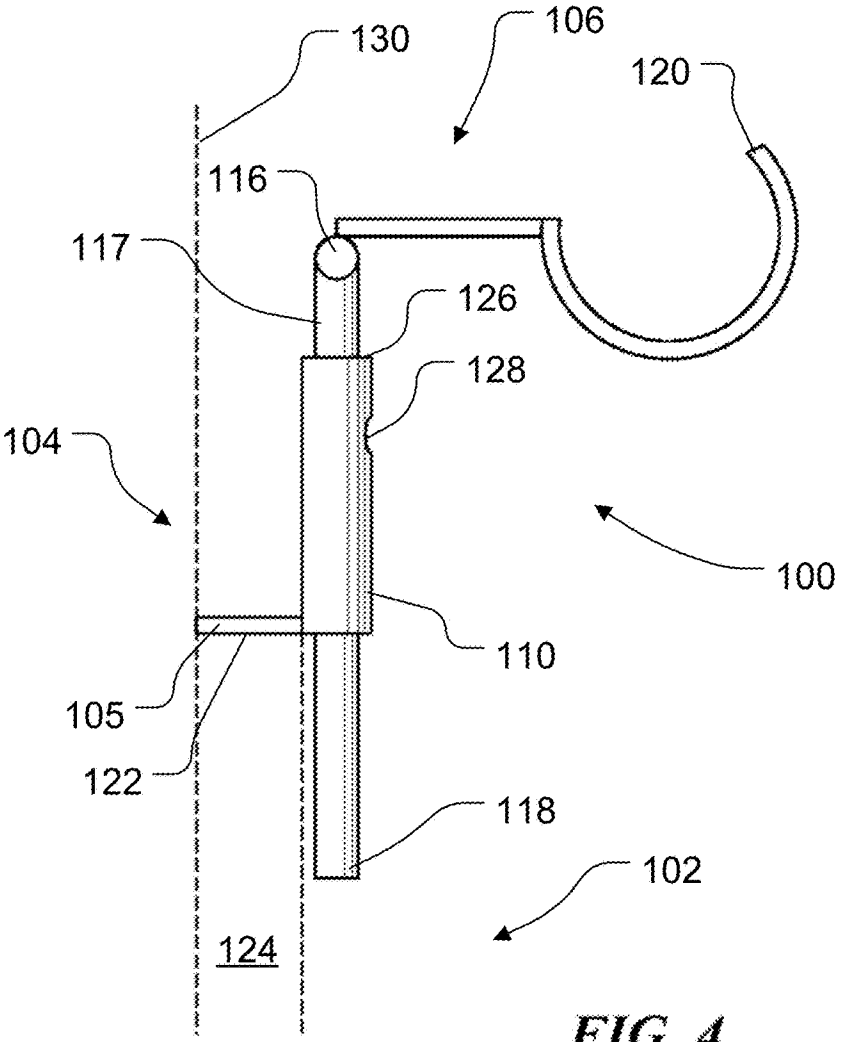
FIG. 4 is a left side view of the curtain rod bracket of FIG. 1.
Figure 6:
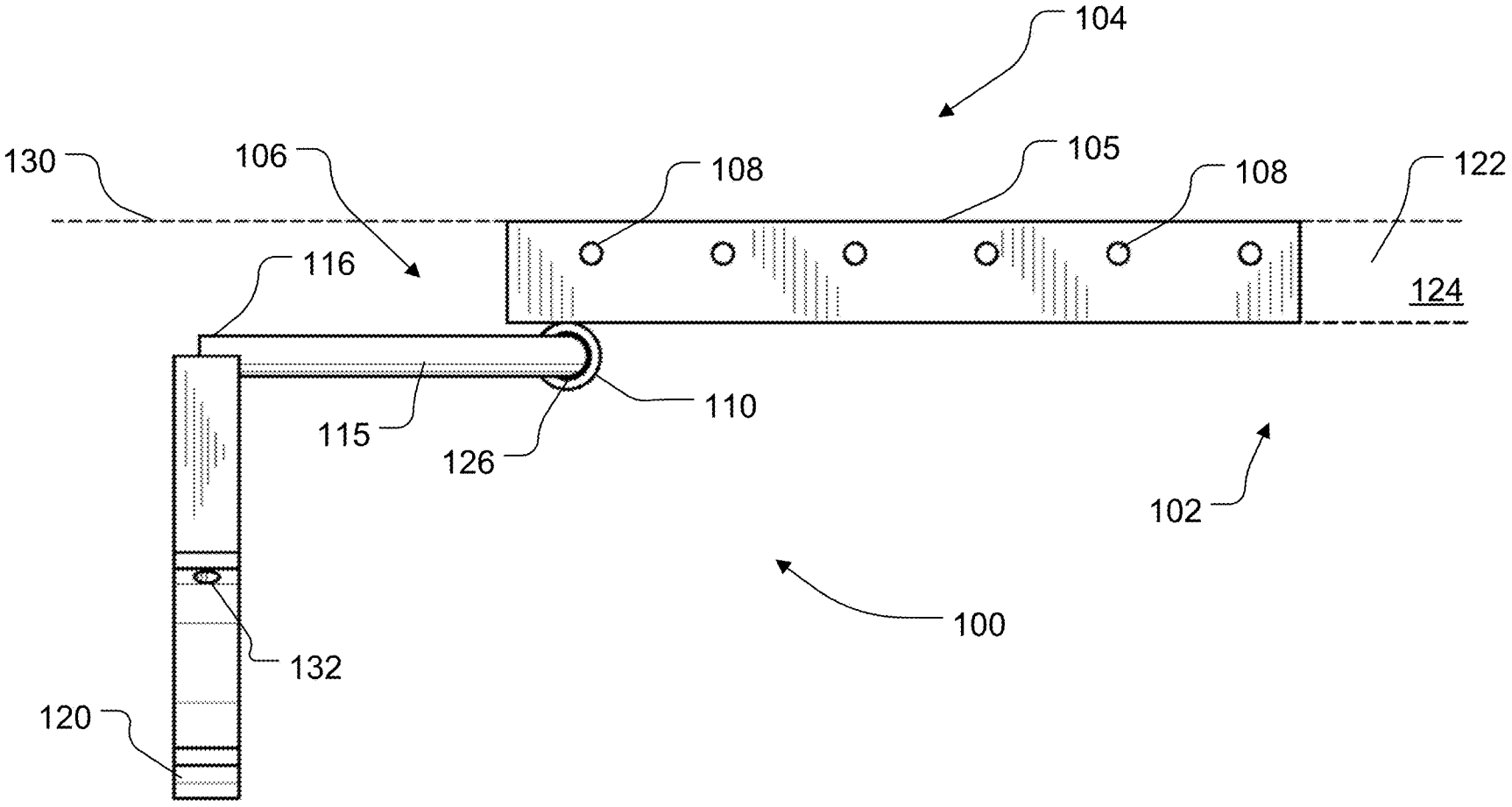
FIG. 6 is a top view of the curtain rod bracket of FIG. 1.
Figure 7:
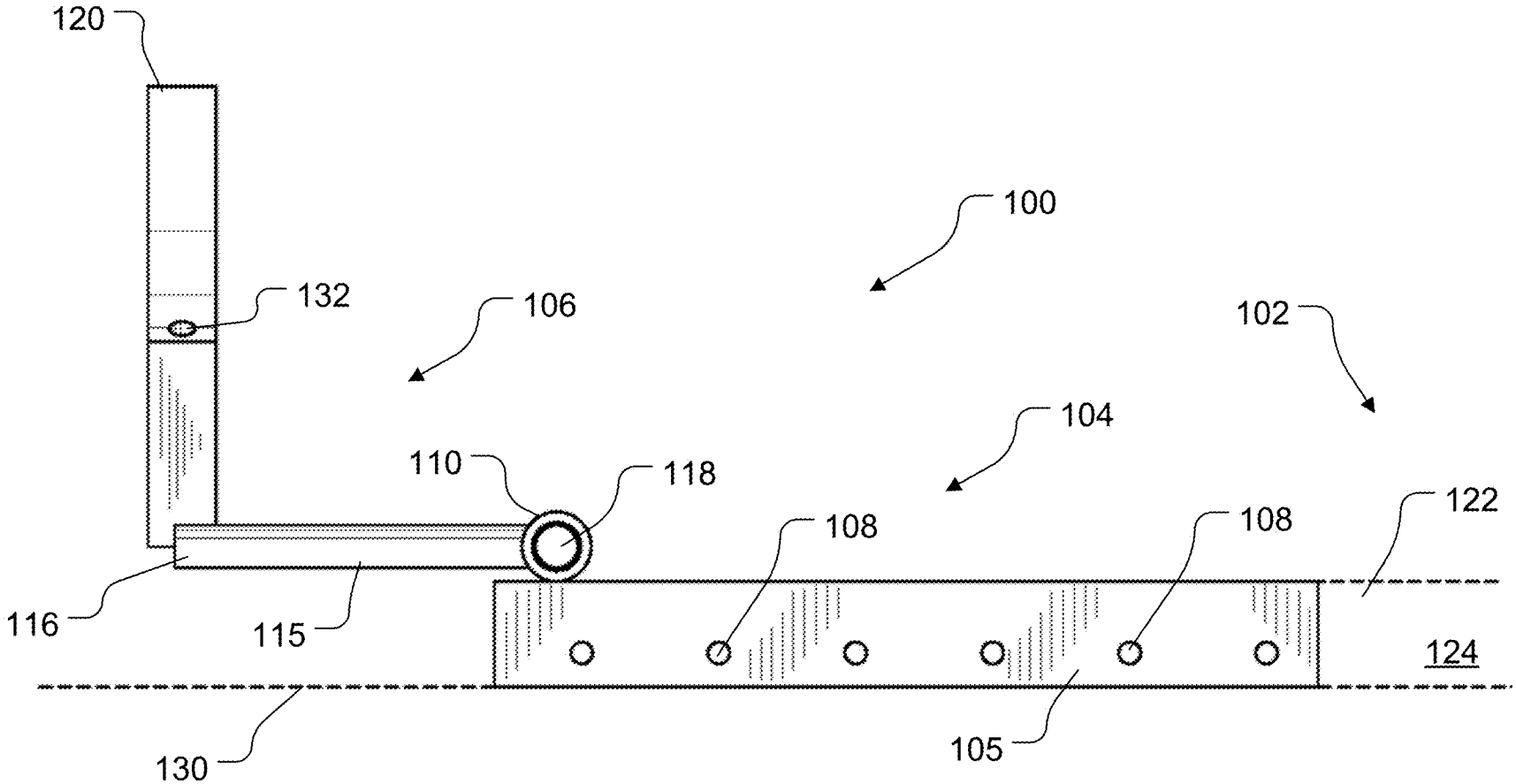
FIG. 7 is a bottom view of the curtain rod bracket of FIG. 1.

Referring to FIGS. 1-7, a curtain rod bracket 100 is installed on one side of a window 102. In a typical scenario, another curtain rod bracket is similarly installed on an opposite side of the window such that a curtain rod (not shown) is supported between the two brackets.

The curtain rod bracket 100 includes a bracket base 104 and a bracket arm 106. The bracket base 104 includes a sleeve 110 attached to an elongate plate 105. In some examples, the sleeve 110 extends in a direction along a first, vertical axis 112 and the elongate plate 105 extends in a direction along a second, horizontal axis 114, substantially perpendicular to the first axis 112. The elongate plate 105 includes a number of through holes 108, evenly spaced along a length of the plate 105. It should be noted that the through holes 108 need not always be evenly spaced, and other suitable arrangements of the through holes are possible.

The bracket arm 106 includes a substantially "L-shaped" rod with a horizontal section 115 having a first end 116 and a vertical section 117 having a second end 118. A semi-circular cradle 120 configured to receive, support, and secure an end of a curtain rod (not shown) is attached to the first end 116 of the horizontal section 115. The vertical section 117 is configured for insertion into the sleeve 110 of the bracket base 104.

2 Installation and Adjustment

To install the curtain rod bracket 100, an installer positions the bracket base 104 with the elongate plate 105 resting on a top surface 122 of the moulding 124 of the window 102. The installer then fastens the bracket base 104 to the moulding 124 by, for example, installing screws through the through holes 108 and into the moulding 124. The through holes 108 are spaced such that the installer can install the bracket base 104 at several different positions on the moulding 124 based on which through holes 108 are situated on the top surface 122 of the moulding.

With the bracket base 104 installed on the moulding 124, the installer assembles the curtain rod bracket 100 by inserting the vertical section 117 of the bracket arm 106 through the sleeve 110 via a top end 126 of the sleeve 110. A height of the bracket arm 106 relative to the window (and relative to the bracket base 104) is adjustable by sliding the vertical section 117 of the bracket arm along the first axis 112. The bracket arm 106, when installed in the sleeve 110, is also rotatable about the first axis 112. In some examples, the bracket arm 106 is rotated such that the horizontal section 115 of the bracket arm 106 is substantially parallel to or rests against the wall 130 adjacent to the window 102, but it should be appreciated that other rotational positions of the horizontal section 115 may be used, based on the installer's requirements.

When the installer is satisfied with the height and rotational position of the bracket arm 106 relative to the window 102, the height and rotational position of the bracket arm 106 is fixed by inserting a set screw (not shown) through a first set screw opening 128 in the sleeve 110. The set screw pinches the vertical section 117 of the bracket arm against an inner surface of the sleeve 110, holding the vertical section 117 in place.

Once an installer has curtain rod brackets 100 installed on either side of the window 102, they can place a curtain rod (not shown) in the semi-circular cradles 120 of the bracket arms 106 and fix the curtain rod in the semi-circular cradles 120 by inserting a set screw (not shown) through a second set screw opening 132 in the semi-circular cradle 120.

Finally, the installer can check if the curtain rod is level and at the correct height relative to the window 102. If not, they can loosen the set screws in the first set screw openings 128 of one or both curtain rod brackets 100 to adjust the height and level of the curtain rod relative to the window 102.

3 Second Embodiment

Figure 8:
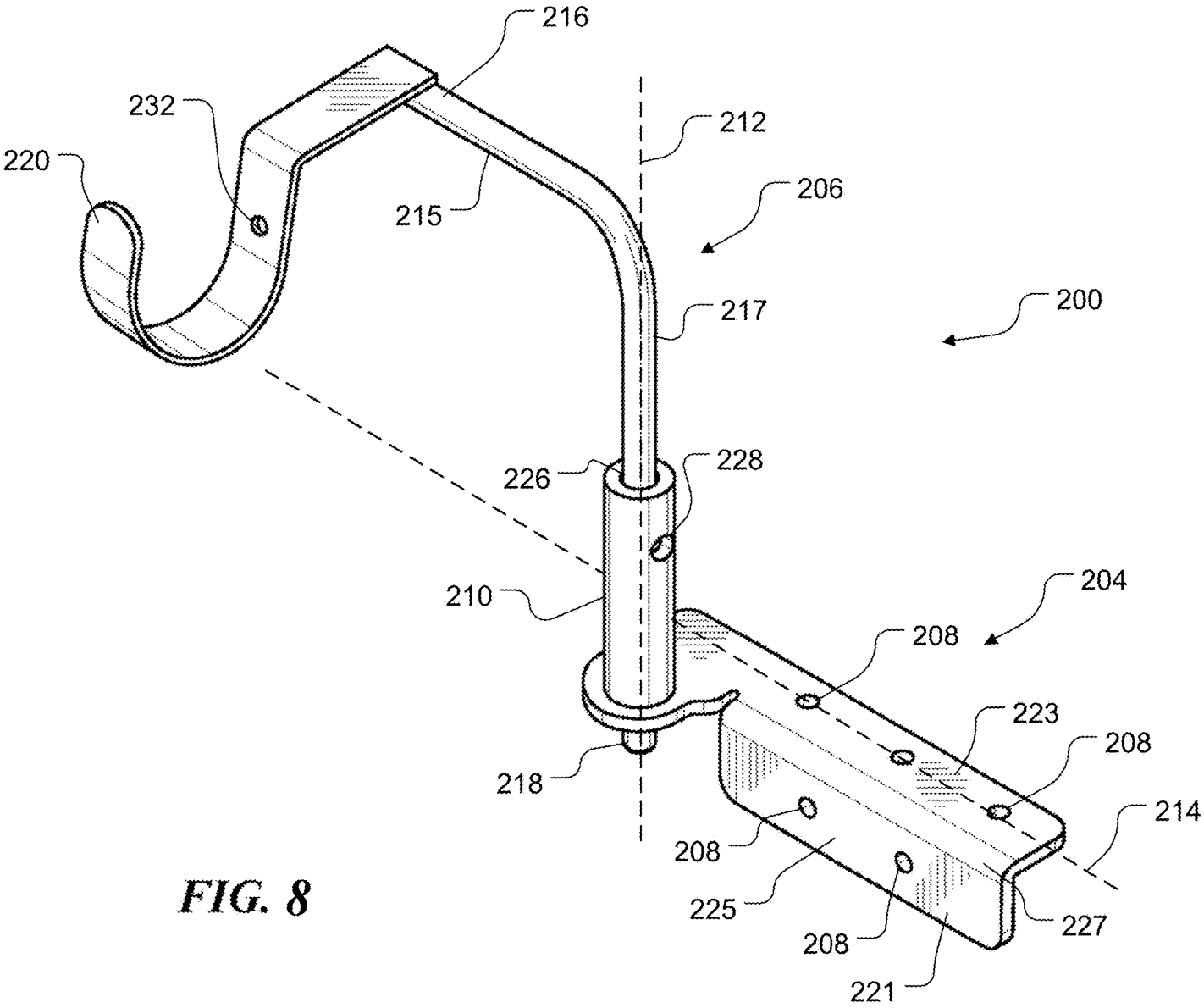
FIG. 8 is a perspective view of a second embodiment of a curtain rod bracket.
Figure 9:
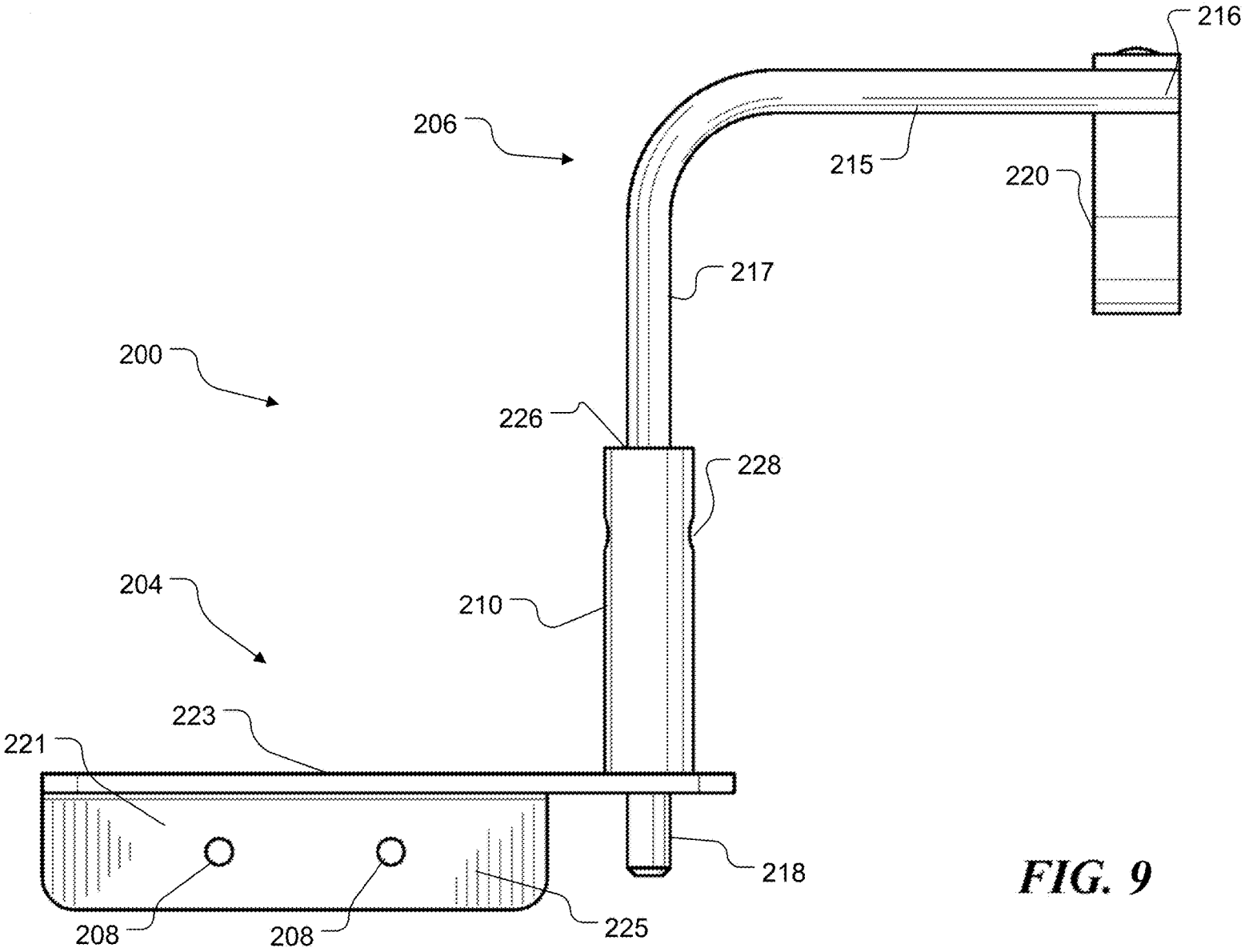
FIG. 9 is a rear view of the curtain rod bracket of FIG. 8.
Figure 10:
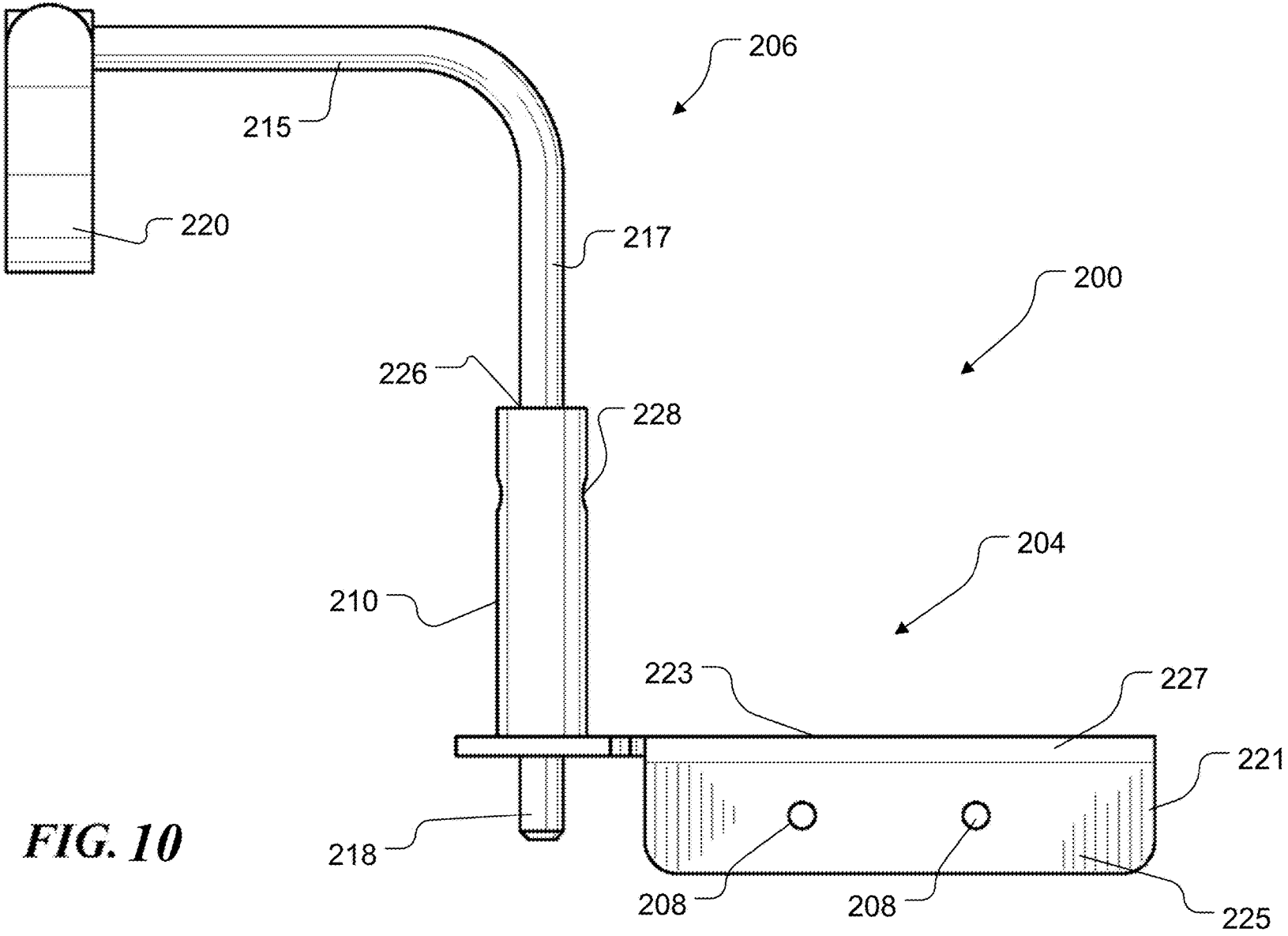
FIG. 10 is a front view of the curtain rod bracket of FIG. 8.
Figure 12:
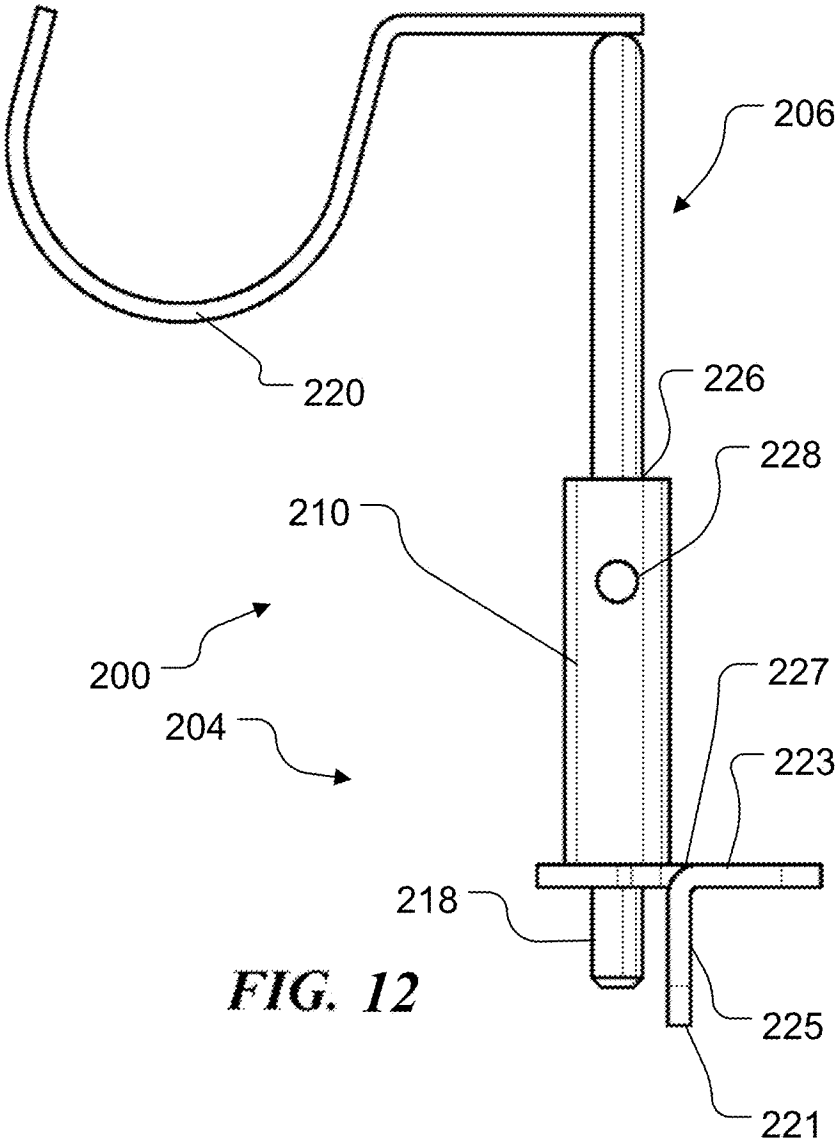
FIG. 12 is a right side view of the curtain rod bracket of FIG. 8.
Figure 11:
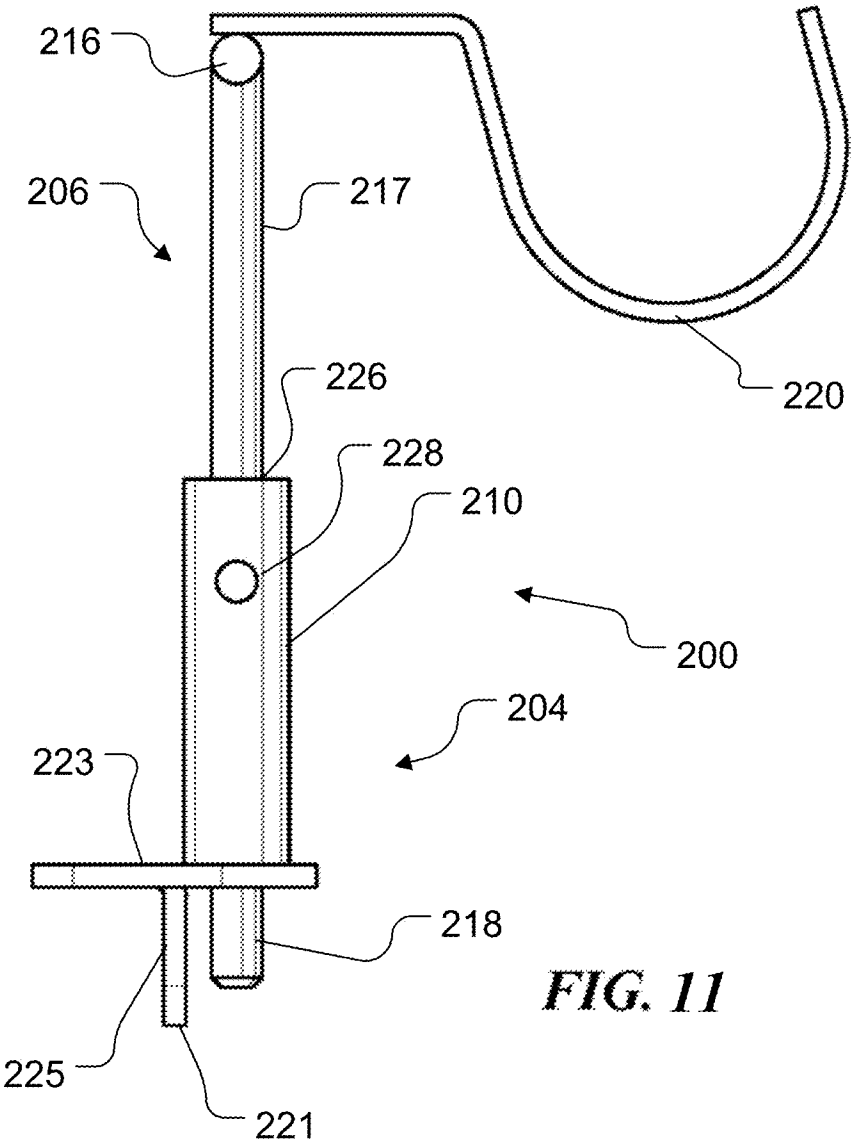
FIG. 11 is a left side view of the curtain rod bracket of FIG. 8.
Figure 13:
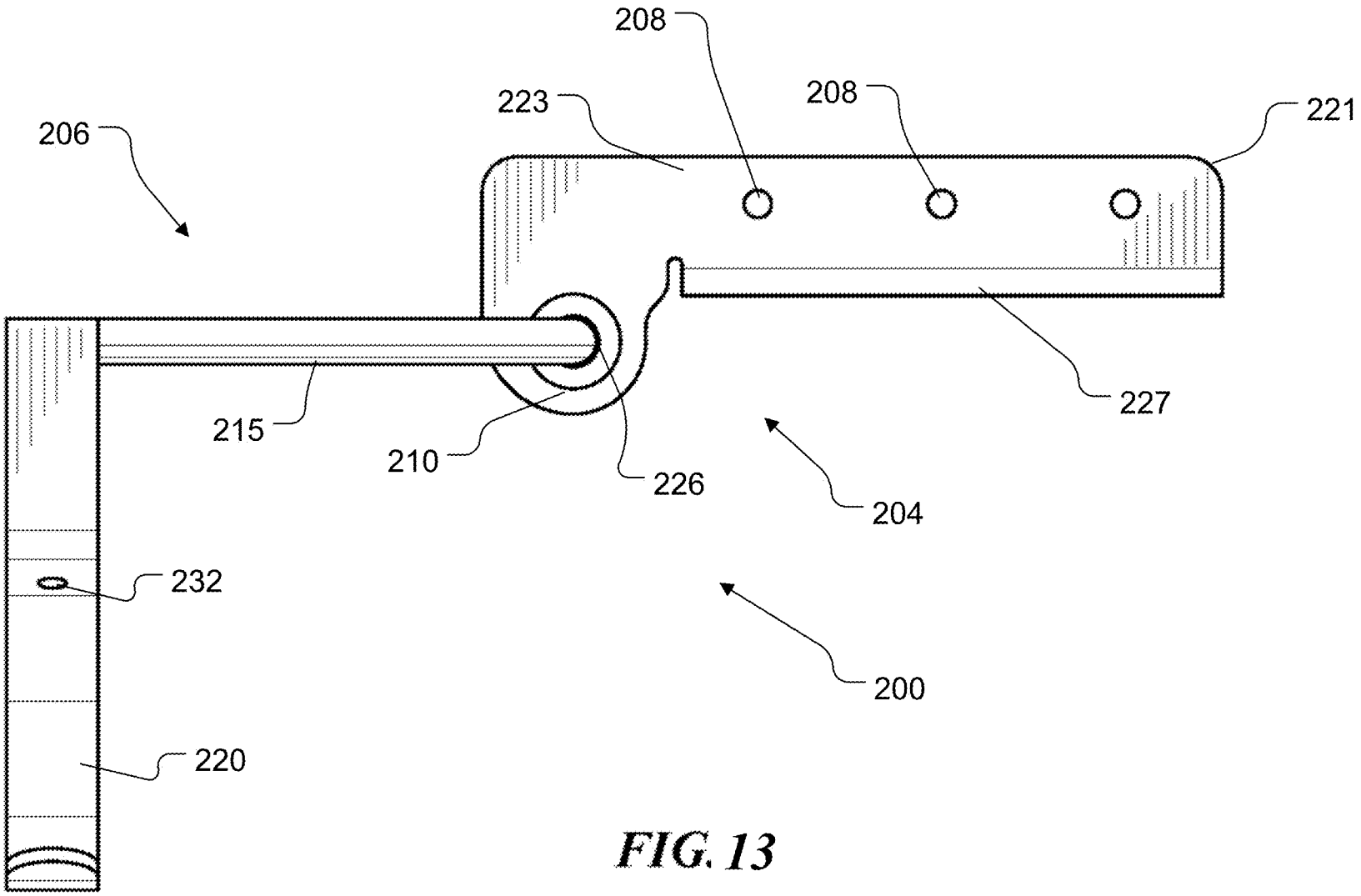
FIG. 13 is a top view of the curtain rod bracket of FIG. 8.
Figure 14:
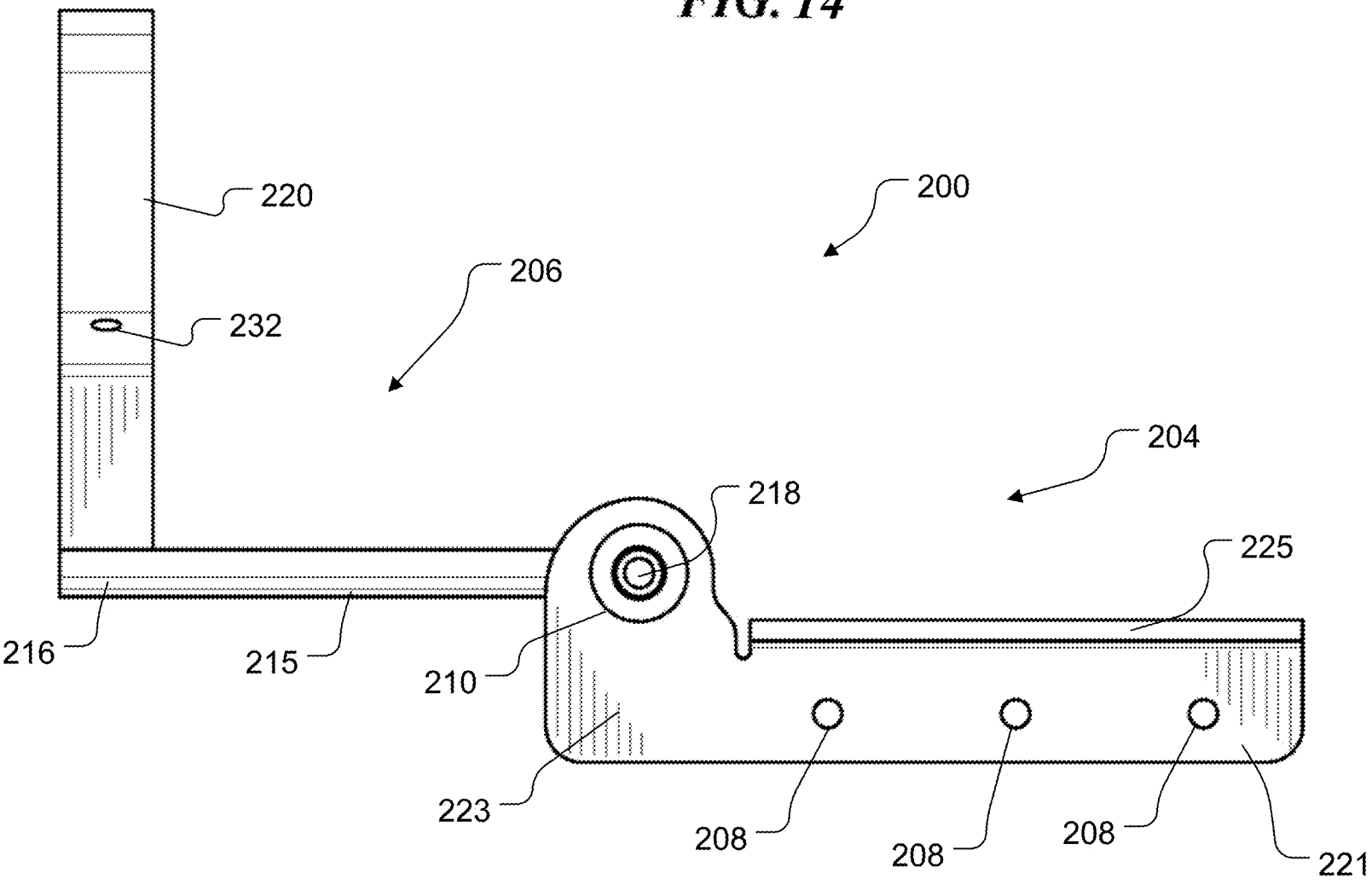
FIG. 14 is a bottom view of the curtain rod bracket of FIG. 8.

Referring to FIGS. 8-14, another embodiment of a curtain rod bracket 200 is installed on one side of a window (not shown, but equivalent to window 101 described above). In a typical scenario, another curtain rod bracket is similarly installed on an opposite side of the window such that a curtain rod (not shown) is supported between the two brackets.

The curtain rod bracket 200 includes a bracket base 204 and a bracket arm 206. The bracket base 204 includes a sleeve 210 attached to an elongate angle brace 221. In some examples, the sleeve 210 extends in a direction along a first, vertical axis 212 and the elongate plate 221 extends in a direction along a second, horizontal axis 214, substantially perpendicular to the first axis 212. The elongate angle brace 221 includes two elongate plates 223, 225 attached at their long ends 227 and arranged substantially orthogonally such that a first of the plates 223 is configured to rest on a top surface of a window moulding and a second of the plates 225 is configured to rest on a front surface of the window moulding. The sleeve 210 has a bottom end attached to a top surface of the bracket base 204 at an end region of the first elongate plate 223, and the sleeve 210 is positioned on the top surface and extends vertically above the top surface of the bracket base 204. Both plates 223, 225 of the elongate angle brace 221 include a number of through holes 208, evenly spaced along their lengths. It should be noted that the through holes 208 need not always be evenly spaced, and other suitable arrangements of the through holes are possible.

The bracket arm 206 includes a substantially "L-shaped" rod with a horizontal section 215 having a first end 216 and a vertical section 217 having a second end 218. A semi-circular cradle 220 configured to receive, support, and secure an end of a curtain rod (not shown) is attached to the first end 216 of the horizontal section 215. The vertical section 217 is configured for insertion into the sleeve 210 of the bracket base 204.

4 Installation and Adjustment

To install the curtain rod bracket 200, an installer positions the bracket base 204 with the elongate angle brace 205 resting on an edge of the moulding of a window. In that position, the plates 223, 225 of the elongate angle brace 221 rest against the top surface and front surface of the moulding, respectively. The installer then fastens the bracket base 204 to the moulding by, for example, installing screws through the through holes 208 and into the moulding. The through holes 208 are spaced such that the installer can install the bracket base 204 at several different positions on the moulding 224 based on which through holes 208 are situated on the top and front surfaces of the moulding.

With the bracket base 204 installed on the moulding, the installer assembles the curtain rod bracket 200 by inserting the vertical section 217 of the bracket arm 206 through the sleeve 210 via a top end 226 of the sleeve 210. A height of the bracket arm 206 relative to the window (and relative to the bracket base 204) is adjustable by sliding the vertical section 217 of the bracket arm along the first axis 212. The bracket arm 206, when installed in the sleeve 210, is also rotatable about the first axis 212. In some examples, the bracket arm 206 is rotated such that the horizontal section 215 of the bracket arm 206 is substantially parallel to or rests against a wall adjacent to the window, but it should be appreciated that other rotational positions of the horizontal section 215 may be used, based on the installer's requirements.

When the installer is satisfied with the height and rotational position of the bracket arm 206 relative to the window, the height and rotational position of the bracket arm 206 is fixed by inserting a set screw (not shown) through a first set screw opening 228 in the sleeve 210. The set screw pinches the vertical section 217 of the bracket arm against an inner surface of the sleeve 210, holding the vertical section 217 in place.

Once an installer has curtain rod brackets 200 installed on either side of the window, they can place a curtain rod (not shown) in the semi-circular cradles 220 of the bracket arms 206 and fix the curtain rod in the semi-circular cradles 220 by inserting a set screw (not shown) through a second set screw opening 232 in the semi-circular cradle 220.

Finally, the installer can check if the curtain rod is level and at the correct height relative to the window. If not, they can loosen the set screws in the first set screw openings 228 of one or both curtain rod brackets 200 to adjust the height and level of the curtain rod relative to the window 202.

5 Alternatives

The above example describes the installation of the curtain rod bracket on either side of a window. It should be appreciated that the curtain rod bracket is not limited to use adjacent to a window. For example, it can be used adjacent to doors or simply used to hang a curtain over a section of wall or over a doorway.

The curtain rod brackets described above have the sleeve attached (e.g., welded) to a side of the elongate plate. This offset arrangement of the sleeve relative to the plate allows the sleeve to be installed over the moulding of the window. However, it should be appreciated that other arrangements of the sleeve are possible (e.g., the sleeve may extend through the elongate plate).

In some examples, the bracket arm is not "L-shaped" but is instead curved, straight, or any other shape suitable to a particular application.

In some examples, the curtain rod bracket is formed from a metal material. In other examples, the curtain rod bracket is formed from a plastic, wood, or other suitable material.

In some examples, the sleeve is cylindrical. In other examples, the sleeve has different shapes (e.g., square, ovular, or another suitable shape).

In the examples above, set screws are used to fix the position of elements relative to one another. However, other suitable mechanisms (e.g., friction fits) can be used to fix the position of the elements relative to one another.

In one example, a bracket for supporting a curtain rod includes a bracket base including an elongate plate having one or more through holes and a sleeve (with a bottom end attached to a top surface of the bracket base), a bracket arm including a vertical section configured for insertion into the sleeve of the bracket base and a cradle attached to a first end of the bracket arm, the cradle configured to receive a curtain rod. The vertical section of the bracket arm is movable in the sleeve along a first, vertical axis to adjust a distance between the cradle and the bracket base.

Examples may include one or more of the following features. The bracket arm may include a horizontal section attached to the vertical section and is substantially "L"-shaped. The horizontal section may have a first end attached to an end of the vertical section and the cradle may be attached to a second end of the horizontal section, opposite the first end of the horizontal section. The sleeve may include a through hole for receiving a set screw to fix a position of the vertical section in the sleeve. The cradle may include a through hole for receiving a set screw to fix the curtain rod in the cradle. The bracket base may be configured for installation on a window moulding, with the elongate plate attached to a top surface of the window moulding.

The elongate plate may have a number of through holes located along its length. The through holes may be equally spaced. The sleeve may be cylindrical. The vertical section may be shaped and sized to fit within the sleeve. The cradle may be located above the bracket base when the bracket is installed. The sleeve may be attached to a side of the elongate plate, offset from a second, horizontal axis extending along a length of the elongate plate. At least one of the bracket base and the bracket arm may be formed from a metal. The vertical section may be rotatable about the first, vertical axis.

The bracket base may includes a second elongate plate attached to the first elongate plate in an angle brace configuration. The bracket base may be configured for installation on a window moulding, with the first elongate plate attached to a top surface of the window moulding and the second elongate plate attached to a front surface or a side of the window moulding. The second elongate plate may have a plurality of through holes located along its length. The cradle may extend away from the first end of the bracket arm in a direction substantially perpendicular to the first end of the bracket arm.

In another example, a kit includes two or more curtain rod brackets configured with any one of the above features and a curtain rod.

In another example, a method for installing a curtain rod bracket configured according to any one of the above features includes fastening the curtain rod base to a window moulding including fastening the elongate base of the curtain rod bracket to a top, front, and/or side surface of the window moulding, inserting the vertical portion of the bracket arm into the sleeve of the curtain rod base, adjusting a distance between the cradle of the bracket arm and the bracket base to a desired distance, and fixing the position of the bracket arm relative to the bracket base.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. A bracket for supporting a curtain rod, the bracket comprising:

a bracket base including a first elongate plate having a plurality of through holes configured to receive fasteners for attaching the first elongate plate to a window moulding, and a sleeve having a bottom end attached to a top surface of the bracket base at an end region of the first elongate plate, the sleeve positioned on the top surface of the bracket base and extending vertically above the top surface of the bracket base, the sleeve defining a first set screw opening and a second set screw opening, the first set screw opening and the second set screw opening being disposed on opposite sides of the sleeve;

a substantially L-shaped bracket arm including a vertical section configured to be vertically inserted into the sleeve of the bracket base and a horizontal section having a first end attached to the vertical section such that the horizontal section is arranged substantially perpendicular to the vertical section; and a cradle attached to a second end of the horizontal section opposite the first end, the cradle configured to receive the curtain rod and extending away from the second end in a direction substantially perpendicular to the horizontal section;

wherein the vertical section of the bracket arm is movable in the sleeve along a first, vertical axis to adjust a distance between the cradle and the bracket base and is rotatable about the first, vertical axis so the horizontal section is positionable substantially parallel to a wall adjacent to the window moulding with the cradle extending away from the wall to space the curtain rod from the window moulding;

wherein the vertical section is movable in the sleeve to a position in which a lower end of the vertical section extends below the first elongate plate;

wherein a set screw received in at least one of the first set screw opening or the second set screw opening bears against the vertical section to fix the distance and a rotational position of the bracket arm relative to the bracket base.

2. The bracket of claim 1 wherein the cradle includes a through hole for receiving a set screw to fix the curtain rod in the cradle.

3. The bracket of claim 1 wherein the bracket base is configured for installation on the window moulding, with the first elongate plate attached to a top surface of the window moulding.

4. The bracket of claim 1 wherein the plurality of through holes are located along a length of the first elongate plate.

5. The bracket of claim 4 wherein the plurality of through holes are equally spaced.

6. The bracket of claim 1 wherein the sleeve is cylindrical.

7. The bracket of claim 1 wherein the vertical section is shaped and sized to fit within the sleeve.

8. The bracket of claim 1 wherein the cradle is located above the bracket base when the bracket is installed.

9. The bracket of claim 1 wherein the sleeve is attached to a side of the first elongate plate, offset from a horizontal axis extending along a length of the first elongate plate.

10. The bracket of claim 1 wherein the bracket base includes a second elongate plate attached to the first elongate plate in an angle brace configuration.

11. The bracket of claim 10 wherein the bracket base is configured for installation on the window moulding, with the first elongate plate attached to a top surface of the window moulding and the second elongate plate attached to a front surface of the window moulding.

12. The bracket of claim 10 wherein the second elongate plate has a plurality of through holes located along a length of the second elongate plate.

13. The bracket of claim 1 wherein the top surface of the bracket base is substantially horizontal.

14. The bracket of claim 13 wherein the plurality of through holes of the first elongate plate extend through the top surface of the bracket base.

* * * * *